United States Patent [19]

Nakamura

[11] Patent Number: 4,660,914

[45] Date of Patent: Apr. 28, 1987

[54] INSULATING COVER FOR TERMINAL

[75] Inventor: Toshinobu Nakamura, Tokyo, Japan

[73] Assignee: Shinagawa Shoko Co., Ltd., Tokyo, Japan

[21] Appl. No.: 880,354

[22] Filed: Jun. 26, 1986

Related U.S. Application Data

[63] Continuation of Ser. No. 689,310, Jan. 7, 1985, abandoned.

[30] Foreign Application Priority Data

Jan. 13, 1984 [JP] Japan ..... 59-3293[U]

[51] Int. Cl.[4] ..... H01R 11/00

[52] U.S. Cl. ..... 339/59 R

[58] Field of Search ..... 339/59 R, 59 M, 60 R, 339/61 R

[56] References Cited

U.S. PATENT DOCUMENTS

| | | | |
|---|---|---|---|
| 3,332,053 | 7/1967 | Busler | 339/59 R |
| 3,994,555 | 11/1976 | Konno et al. | 339/59 R |
| 4,225,205 | 9/1980 | Sinclair et al. | 339/59 M |
| 4,243,287 | 1/1981 | Smith et al. | 339/59 R |

*Primary Examiner*—Gil Weidenfeld
*Assistant Examiner*—Paula A. Austin
*Attorney, Agent, or Firm*—Fidelman, Wolffe & Waldron

[57] ABSTRACT

An insulating cover for a terminal. A cover body is composed of a synthetic resin formed into a sleeve. The cover body comprises a sleeve portion for receiving the head portion of the terminal which is connected to a wire and two fitting portions for enclosing the remaining portion of the terminal together with the wire. The two fitting portions are connected to the sleeve such as to be freely opened and closed at the connecting point. In the main portions, the fitting portions have engaging hooked pin portions and receiving hole portions for securely retaining the terminal.

2 Claims, 21 Drawing Figures

INSULATING COVER FOR TERMINAL

This application is a continuation of application Ser. No. 689,310, filed Jan. 7, 1985 now abandoned.

BACKGROUND OF THE INVENTION

This invention relates to an insulating cover for a terminal, and more particularly to improvements in an insulating cover for a terminal used for insulating a connecting terminal of a coated wire.

Conventionally, such an insulating cover for a terminal as is shown in FIGS. 1 and 2 has been in wide use. This insulating cover shown in FIG. 1 is a cover for a flat-type terminal. The referential numeral 1 denotes a flat-type terminal, 2 a coated wire, and 3 a sleeve-type cover made of a soft vinyl chloride resin. This sleeve-type cover is attached to the wire by taking the complicated steps of (a) inserting the wire into the cover in advance, (b) attaching the terminal to the wire by contact bonding, (c) moving the cover to the position suitable for covering the terminal, and (d) fitting the cover so as to enclose the terminal therewith.

The cover attachment operation is, therefore, very inefficient, and various sizes of covers are required in accordance with the sizes of wires and terminals; that is, there are many problems to solve in terms of control of parts and mass production.

In FIG. 2, another cover for a flat-type terminal is shown. A cover 4 is made of a hard synthetic resin, and has a projection 4*a* and a stopper piece 4*b* contained within it. After the terminal has been attached to the wire by contact bonding, the cover is moved to a position appropriate for covering the terminal in order to enclose it together with the wire. This cover 4 is prevented from slipping off the wire by its engagement with the projection 4*a* and the stopper piece 4*b*, which structure facilitates the fitting to the terminal as compared with the cover shown in FIG. 1. However, the cover of this structure has a problem in that though insertion and fitting are easy in the case of a thick wire, in the case of a thin wire, which is easily bent, insertion and retention are difficult and some subsidiary means are required.

SUMMARY OF THE INVENTION

Accordingly, it is an object of the invention to solve the problem described above, and to provide an insulating cover for a terminal which requires no force for insertion of and engagement with the terminal, which is able to enclose the terminal with great ease and simplicity without the use of any subsidiary means, and which is suitable for mass production.

To this end, this invention provides an insulating cover for a terminal formed into a sleeve of a synthetic resin such as nylon or hard vinyl chloride which comprises: a sleeve portion for receiving the head portion of a terminal which is connected to a wire; and two fitting portions for covering the remaining portion of the terminal together with the wire which may be freely opened and closed at the point where the fitting portions are connected to the sleeve portion; and which, in the main portion, has engaging portions for fitting to each other when the two fitting portions are closed, and protruding portions for restricting and retaining the movement of the terminal.

BRIEF DESCRIPTION OF THE DRAWINGS

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
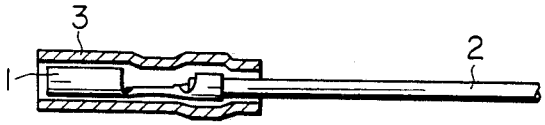
FIGS. 1 and 2 are sectional views of the conventional insulating covers for terminals.
Figure 2:
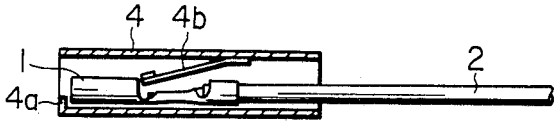

Referring now to FIGS. 3 to 10, there is shown an embodiment of an insulating cover for a terminal according to the invention. This embodiment is used for insulating a linear flat-type terminal (1) which is connected to a wire (2).

An insulating cover body (A) is formed of a synthetic resin such as nylon or hard vinyl chloride, and is divided into two portions in the longitudinal direction in which the terminal (1) is inserted. One division is a sleeve portion (10) having a rectangular section for easily receiving the insertion of the head portion (1*a*) of the flat-type terminal (1). On the inner surface at the end of the sleeve portion a projection (10*a*) is provided for restricting the inserting position of the terminal and the sleeve portion (10) has at one end an opening with a lip (10*b*) which is formed at this end with a lip so that its walls are in this portion thinner than the main portion of the outer walls of the sleeve portion for the purpose which will be described later. The other portion of the cover body is further vertically divided into two box-shaped fitting portions (11), (12), which are connected to the sleeve portion (10) at the lip of the opening with a lip (10*b*) such as to be freely bent, opened and closed. Each end of the fitting portions (11), (12) is a lead portion (11*a*), (12*a*) having a smaller inner width. On the protruding fitting positions at the four corners of one (11) of the fitting portions, are provided hooked pins (11*b*), on the bases of which reinforcing ribs (11*c*) are integrally provided. On the protruding fitting positions at the four corners of the other fitting portion (12), receiving holes (12*b*) for receiving the hooked pins (11*b*) are formed, and on the inner surface of each receiving hole (12*b*), a projection (12*c*) for retaining the hook of the hooked pin (11*b*) is provided.

Figure 8:
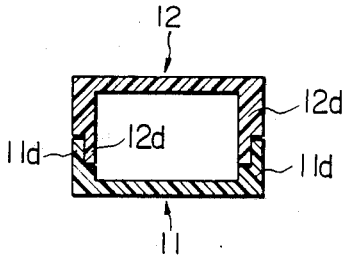
FIG. 8 is a sectional view of the fitting portions of the cover.
Figure 9:
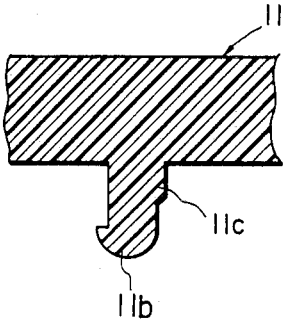
FIG. 9 is an enlarged sectional view of a hook pin portion.
Figure 10:
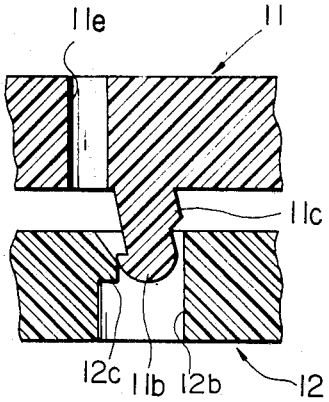
FIG. 10 is a sectional view of an engaging portion of the hook pin and receiving hole.

Each of the opposing side plates (11*d*), (12*d*) of the box-shaped fitting portions (11), (12) are formed such as to dovetail into each other when fitted (see FIG. 8).

Figure 7:
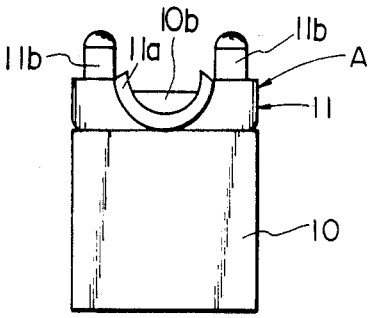

The abutting surfaces of the lead portions (11*a*), (12*a*) are cut obliquely such that the opposing surfaces fit each other snugly (see FIG. 7).

Incidentally, the holes (11*e*) adjacent to the hooked pins (11*b*) are holes necessary for synthetic resin formation.

Figure 3:
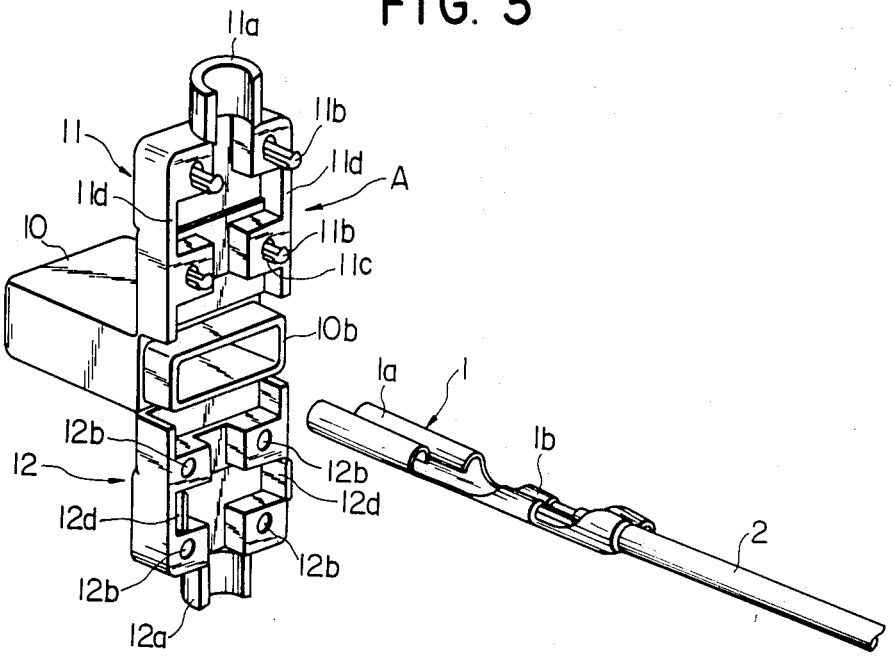
FIG. 3 is a perspective view of an embodiment of an insulating cover for a terminal according to the invention.
Figure 4:
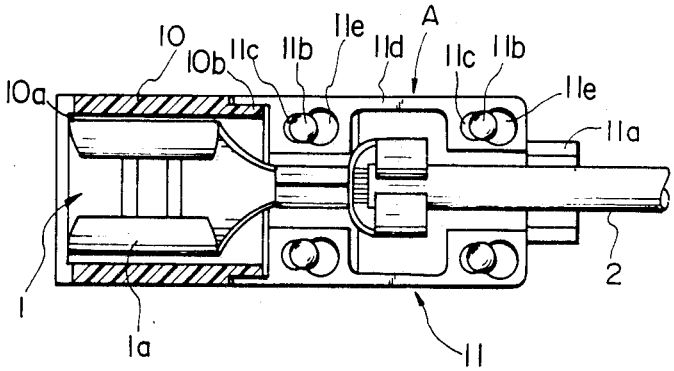
FIG. 4 is a cross sectional view of the cover shown in FIG. 3 with a terminal inserted.
Figure 5:
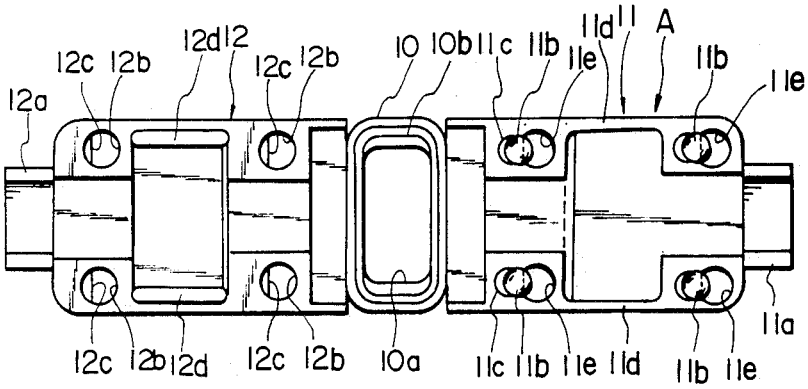
FIG. 5 is an enlarged plan view of the cover with the fitting portions opened.
Figure 6:
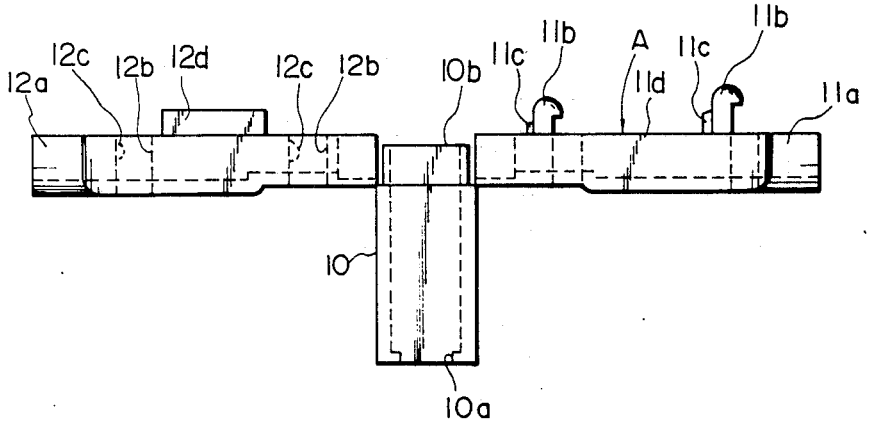
FIGS. 6 and 7 are a side view and an end view, respectively, of the cover shown in FIG. 5.

The insulating cover for a terminal of the above-described structure encloses the terminal in the way shown in FIGS. 3 and 4. That is, when the fitting portions (11), (12) are opened, the head portion (1*a*) of the terminal (1) which is connected to the wire by contact bonding is inserted into the receiving portion at the end of the sleeve portion (10) to the position where the terminal abuts the inner projection (10*a*), and thereafter both fitting portions (11) (12) are pressed tightly together.

This pressing operation inserts the hooked pins (11*b*) of the fitting portion (11) into the receiving holes (12*b*) of the fitting portion (12). During the pressing operation, the hooked pins (11*b*) are slightly inclined from their upright posture by virtue of the projections (12*c*) at the entrance of the receiving holes (12*b*), but after passing this position, they recover the original posture, whereby the hooks are retained by the projections (12*c*) such as to prevent slipping off.

When the fitting portions (11), (12) are closed, as is shown in FIG. 8, the opposing side plates (11*d*), (12*d*) dovetail into each other, and a part of each of the opposing side plates (11*d*), (12*d*), respectively, fits around the opening with a lip (10*b*) of the sleeve portion (10). When the fitting portions (11), (12) are closed, the protruding portions at the four corners of both fitting portions are situated at the head portion (1*a*) and the narrow portion of the wire contacting portion (1*b*), and these protruding portions retain the cover body (A) such that it does not move from this terminal enclosing position. The insulating cover which encloses the terminal in this way can be removed from the terminal by pushing and opening the fitting portions (11), (12).

Therefore, this structure of insulating cover dispenses with the need for a troublesome task of inserting the wire and the terminal into the cover, and enables a simple operation of enclosing the terminal by inserting only the head portion of the terminal into the sleeve portion of the cover, and closing and pressing the fitting portions with the thumb and first finger. In this way, working efficiency in cover attachment can be remarkably heightened. Furthermore, since the terminals can be retained fast within the cover, there is no danger of slippage when the terminal is fitted to a tab terminal, whereby an accident caused by bad connection or bad insulation can be prevented.

Furthermore, since the fitting portions (11), (12) have a structure in which the opposing side plates dovetail into each other and a part of each of the opposing side plates (11*d*), (12*d*), respectively, fits without a gap around the opening with a lip (10*b*) of the sleeve portion (10), there is an adequate creeping distance in respect to electrical insulation as compared with the structure in which the opposing side plates only abut each other, whereby superior insulation effect is obtained.

In addition, according to the above-described structure, since the narrow hooked pins (11*b*) are integrally formed with the reinforcing ribs (11*c*) at the bases, when the pins are inserted into the receiving holes (12*b*), in spite of a slight inclination being caused by the projections (12*c*) in the receiving holes, not only is there a repulsing which restores the pins to their original upright posture, but the pins are prevented from being damaged.

Figure 11:
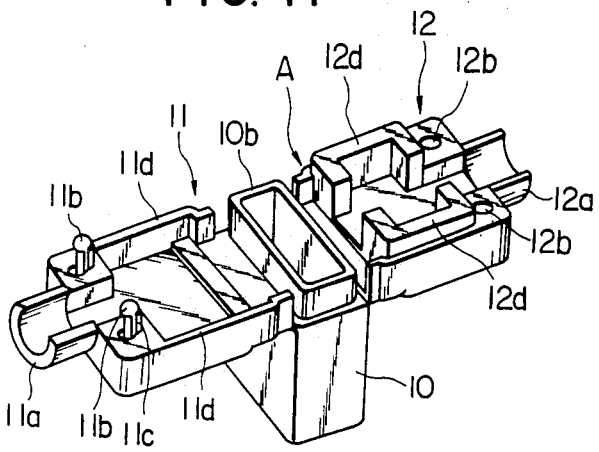
FIG. 11 is a perspective view of another embodiment of an insulating cover for a terminal according to the invention.
Figure 12:
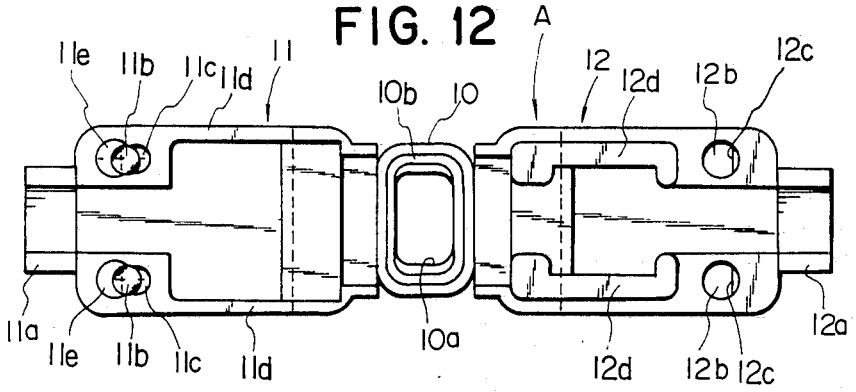
FIG. 12 is an enlarged plan view of the cover shown in FIG. 11 with the fitting portions opened.
Figure 13:
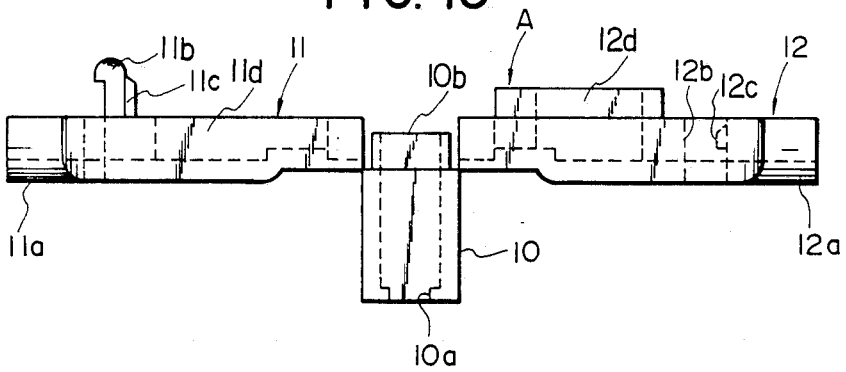
FIG. 13 is a side view of the cover shown in FIG. 12.
Figure 14:
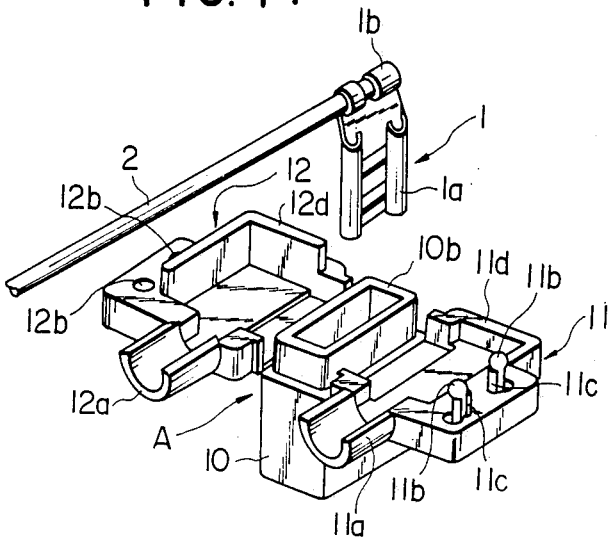
FIG. 14 is a perspective view of a further embodiment of an insulating cover for a terminal according to the invention.
Figure 15:
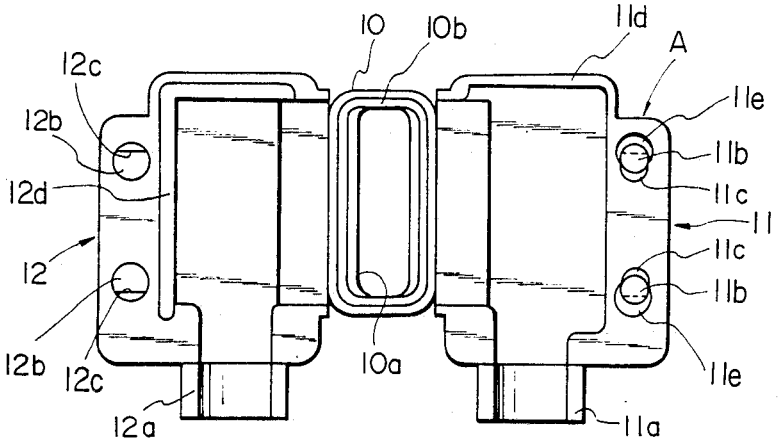
FIG. 15 is an enlarged plan view of the cover shown in FIG. 14 with the fitting portions opened.
Figure 16:
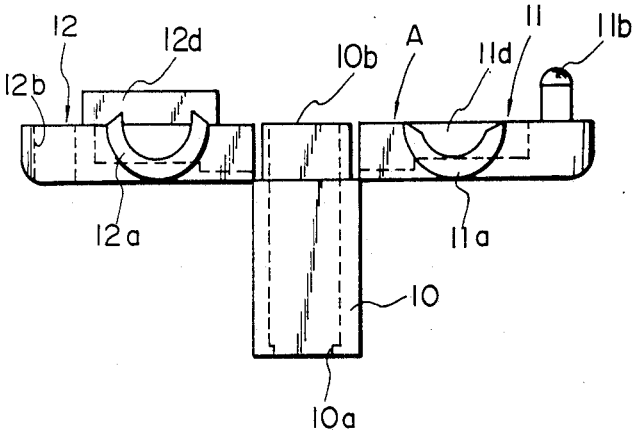
FIG. 16 is a side view of the cover shown in FIG. 15.
Figure 17:
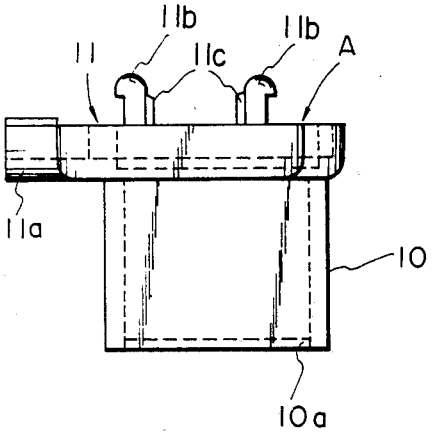
FIG. 17 is an end view of the cover shown in FIG. 15.
Figure 18:
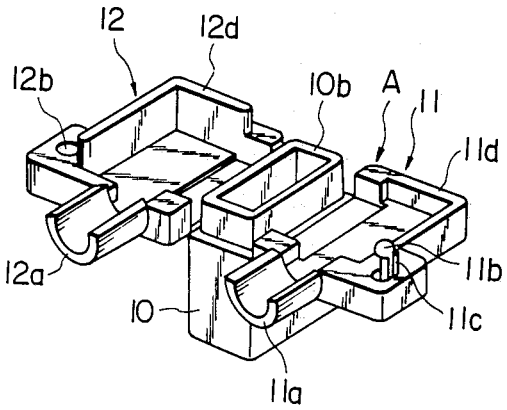
FIG. 18 is a perspective view of a still further embodiment of an insulating cover for a terminal according to the invention.
Figure 19:
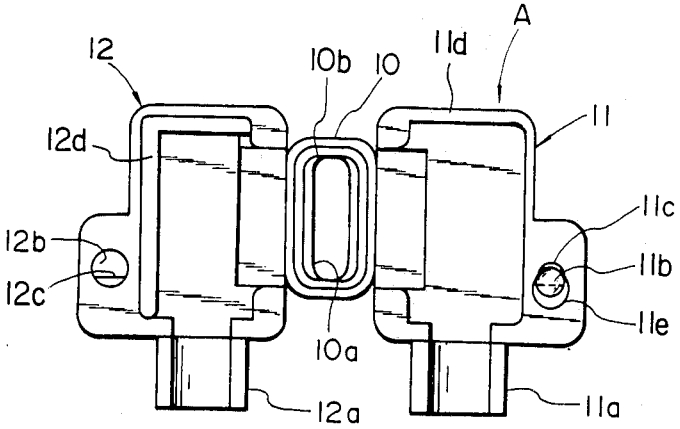
FIG. 19 is an enlarged plan view of the cover shown in FIG. 14 with the fitting portions opened.
Figure 20:
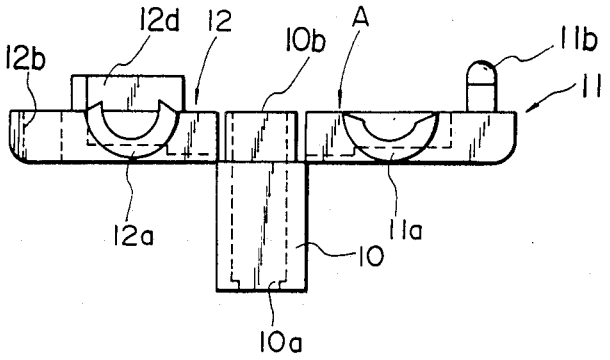
FIG. 20 is a side view of the cover shown in FIG. 19.
Figure 21:
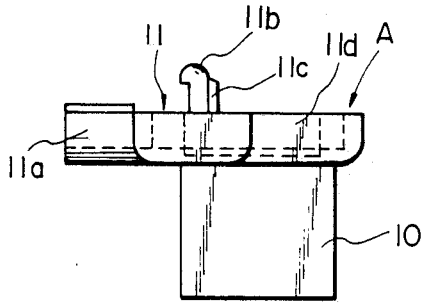
FIG. 21 is an end view of the cover shown in FIG. 19.

FIGS. 11 to 13 show another embodiment of the invention. In this embodiment, two hooked pins (11*b*) and two receiving holes (12*b*) corresponding thereto retain the fitting portions (11*d*), (12*d*), and one of the opposing side plates is formed with a protruding lip such as to dovetail into the other side plate (11*d*).

In FIGS. 14 to 17 is shown an example in which a further embodiment of the invention is used for an insulating cover for a flag-type terminal (1). The two hooked pins (11*b*) and the two receiving holes (12*b*) corresponding thereto retain the fitting portions (11*d*), (12*d*), and one of the opposing side plates is formed with a protruding lip such as to dovetail into the other side plate (11*d*).

A still further embodiment of the invention is shown in FIGS. 18 to 21. This cover is also used for a flag-type terminal. In this embodiment, one hooked pin (11*b*) and one receiving hole (12*b*) corresponding thereto retain the fitting portions (11), (12), and two sides of one (12*d*) of the opposing side plates (11*d*), (12*d*) are formed with a protruding lip such as to dovetail into the other side plate (11*d*).

As described above, according to the invention, an insulating cover for a terminal formed into a sleeve of a synthetic resin such as nylon or hard vinyl chloride is composed of: a sleeve portion for receiving the head portion of a terminal which is connected to a wire; and two fitting portions for covering the remaining portion of the terminal together with the wire which can freely open and close at the point where the fitting portions are connected to the sleeve portion; and which, in the main portion, has hooked pin portions and receiving hole portions for fitting to each other when the two fitting portions are closed. Accordingly, not only is attachment to a terminal simple and easy and the enclosed terminal securely retained, but also an insulating cover for a terminal which is suitable for mass production irrespective of the sizes of terminals or wires can be provided.

While there have been described what are at present considered to be preferred embodiments of the invention, it will be understood that various modifications may be made therein, and it is intended that the appended claims cover all such modifications as fall within the true spirit and scope of the invention.

What is claimed is:

1. In an electrical insulating cover for an electrical terminal and a connection of said terminal to a pre-attached wire, said terminal being generally rigid for purposes of mounting in said cover and having a head portion and a remaining portion, with said remaining portion being connected to said wire, and said cover having a cover body formed of synthetic resin with two fitting portions integrally hinged to said body, said two fitting portions having engaging portions internal of each fitting portion and providing a snapfit latch upon manual closing of said fitting portions about said terminal and pre-attached wire and means for restricting movement of and retaining said terminal when said fitting portions are closed, the improvement comprising:

a tubular sleeve means for receiving said head portion of said terminal during insertion of said head portion thereinto along an insertion path generally coaxial with said sleeve, said sleeve means extending generally one half of a length of said cover body; and said cover body, upon closing of said fitting portions about said remaining portion and pre-attached wire, covering substantially all of said terminal and pre-attached wire;

whereby said remaining portion is graspable by a person attaching said cover to said terminal during inserting of said head portion into said sleeve means, said sleeve means aiding in support of said terminal during subsequent closing of said fitting portions, so that a flexibility of said wire does not detract from said inserting and mounting.

2. The improvement as in claim 1, and further comprising:

said fitting portions being slightly shiftable in order to unlatch said engaging portions and open said cover.

* * * * *